US009777603B2

(12) United States Patent
Kaan et al.

(10) Patent No.: US 9,777,603 B2
(45) Date of Patent: Oct. 3, 2017

(54) SHIFTING CAMSHAFT GROOVE DESIGN FOR LOAD REDUCTION

(71) Applicant: GM Global Technology Operations LLC, Detroit, MI (US)

(72) Inventors: Bradley R. Kaan, Oxford, MI (US); Domenic Certo, Niagara Falls (CA); Joseph J. Moon, Beverly Hills, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 77 days.

(21) Appl. No.: 15/053,591

(22) Filed: Feb. 25, 2016

(65) Prior Publication Data

US 2017/0248043 A1 Aug. 31, 2017

(51) Int. Cl.

| | |
|---|---|
| ***F01L 1/34*** | (2006.01) |
| ***F01L 1/047*** | (2006.01) |
| *F01L 13/00* | (2006.01) |

(52) U.S. Cl.

CPC ..... *F01L 1/34* (2013.01); *F01L 1/047* (2013.01); *F01L 13/0036* (2013.01); *F01L 2820/03* (2013.01)

(58) Field of Classification Search

CPC ..... F01L 1/34; F01L 1/047; F01L 13/0036; F01L 2820/03

USPC ..... 123/90.16, 90.18, 90.6

See application file for complete search history.

(56) References Cited

U.S. PATENT DOCUMENTS 8,863,714 B1 * 10/2014 Moran ..... F01L 13/0036 123/90.18

9,032,922 B2 5/2015 Moon et al.

* cited by examiner

*Primary Examiner* — Ching Chang

(74) *Attorney, Agent, or Firm* — Harness, Dickey & Pierce, P.L.C.

(57) ABSTRACT

A camshaft assembly includes a base shaft including at least one lobe pack axially movably mounted on the base shaft, the lobe pack including a control groove therein. An actuator device includes a pin movably mounted to the actuator between a retracted position and an extended position for engaging with the control groove to cause axial movement of the lobe pack. The control groove includes a pin engagement region, a shifting region and an ejection region. The pin engagement region of the control groove has a first pair of sidewalls. The shifting region extends from the pin engagement region and has a second pair of sidewalls angled relative to the first pair of sidewalls and having a first portion with a varying groove width that varies relative to a groove width of the pin engagement region.

4 Claims, 5 Drawing Sheets

SHIFTING CAMSHAFT GROOVE DESIGN FOR LOAD REDUCTION

FIELD

The present disclosure relates to a camshaft assembly for an internal combustion engine.

BACKGROUND

This section provides background information related to the present disclosure which is not necessarily prior art.

Automotive vehicles typically include an internal combustion engine defining one or more cylinders. The engine includes intake valves for controlling inlet charge into the cylinders and exhaust valves for controlling the flow of exhaust gases out of the cylinders. The engine assembly further includes a valve train system for controlling operation of the intake and exhaust valves. Commonly assigned U.S. Pat. No. 9,032,922 discloses a camshaft assembly for controlling the motion of the intake and exhaust valves of an internal combustion engine. The camshaft assembly includes a base shaft extending along a longitudinal axis, lobe packs mounted on the base shaft, and a plurality of actuators for axially moving the lobe packs relative to the base shaft. Each of the lobe packs includes a plurality of cam lobes. The axial position of the lobe packs relative to the base shaft can be adjusted in order to change the valve lift profile of the intake and exhaust valves. It is useful to adjust the valve lift profile of the intake and exhaust valves depending on the engine operating conditions. To do so, the lobe packs that control the movement of the exhaust and intake valves can be moved axially relative to the base shaft. Actuators, such as solenoids, can be used to move the lobe packs axially relative to the base shaft. In particular, the lobe pack can include a control groove. The actuator of the camshaft assembly includes an actuator body and at least one pin movable coupled to the actuator body. The pin can move relative to the actuator body between a retracted position and an extended position. The axially movable lobe pack can move axially relative to the base shaft when the base shaft rotates about the longitudinal axis and the pin is in the extended position and at least partially disposed in the control groove. The present disclosure provides an improved control groove design to minimize actuator pin to shifting groove wall impact force and thereby reducing pin failures.

SUMMARY

This section provides a general summary of the disclosure, and is not a comprehensive disclosure of its full scope or all of its features.

A camshaft assembly includes a base shaft including at least one lobe pack axially movably mounted on the base shaft, the lobe pack including a control groove therein. An actuator device includes a pin movably mounted to the actuator between a retracted position and an extended position for engaging with the control groove to cause axial movement of the lobe pack. The control groove includes a pin engagement region, a shifting region and an ejection region. The pin engagement region of the control groove has a first pair of parallel sidewalls. The shifting region extends from the pin engagement region and has a second pair of sidewalls angled relative to the first pair of parallel sidewalls and having a first portion with a varying groove width that narrows relative to a groove width of the pin engagement region.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
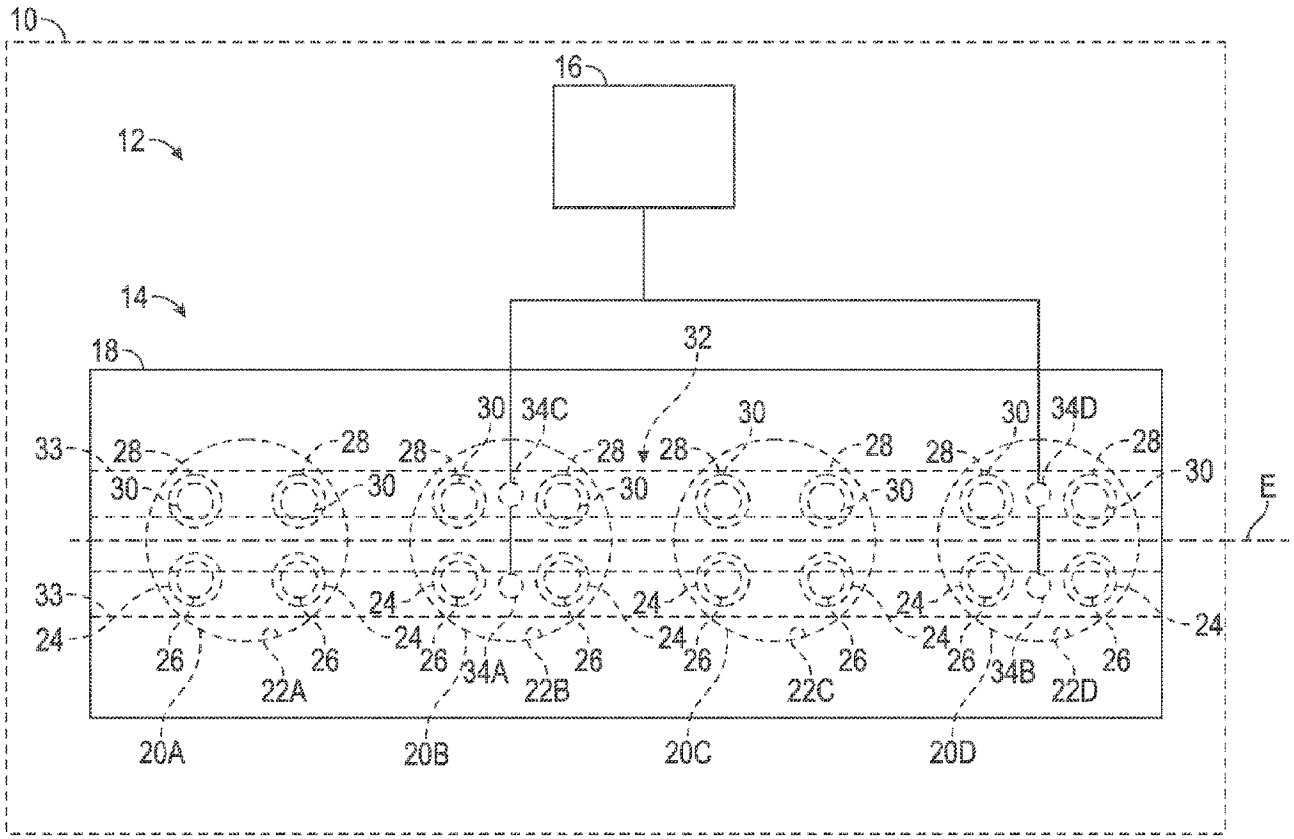
FIG. 1 is a schematic diagram of a vehicle including an engine assembly.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Referring to the drawings, wherein like reference numbers correspond to like or similar components throughout the several figures, FIG. 1 schematically illustrates a vehicle 10 such as a car, truck or motorcycle. The vehicle 10 includes an engine assembly 12. The engine assembly 12 includes an internal combustion engine 14 and a control module 16, such an engine control module (ECU), in electronic communication with the internal combustion engine 14. The internal combustion engine 14 includes an engine block 18 defining a plurality of cylinders 20A, 20B, 20C, and 20D. In other words, the engine block 18 includes a first cylinder 20A, a second cylinder 20B, a third cylinder 20C, and a fourth cylinder 20D.

Although FIG. 1 schematically illustrates four cylinders, the internal combustion engine 14 may include more or fewer cylinders. The cylinders 20A, 20B, 20C, and 20D are spaced apart from each other but may be substantially aligned along an engine axis E. Each of the cylinders 20A, 20B, 20C, and 20D is configured, shaped and sized to receive a piston (not shown). The pistons are configured to reciprocate within the cylinders 20A, 20B, 20C, and 20D. Each cylinder 20A, 20B, 20C, 20D defines a corresponding combustion chamber 22A, 22B, 22C, 22D. During operation of the internal combustion engine 14, an air/fuel mixture is combusted inside the combustion chambers 22A, 22B, 22C, and 22D in order to drive the pistons in a reciprocating manner. The reciprocating motion of the pistons drives a crankshaft (not shown) operatively connected to the wheels (not shown) of the vehicle 10. The rotation of the crankshaft can cause the wheels to rotate, thereby propelling the vehicle 10.

In order to propel the vehicle 10, an air/fuel mixture should be introduced into the combustion chambers 22A, 22B, 22C, and 22D. To do so, the internal combustion engine 14 includes a plurality of intake ports 24 fluidly coupled to an intake manifold (not shown). In the depicted embodiment, the internal combustion engine 14 includes two intake ports 24 in fluid communication with each combustion chamber 22A, 22B, 22C, and 22D. However, the internal combustion engine 14 may include more or fewer intake ports 24 per combustion chamber 22A, 22B, 22C, and 22D.

The internal combustion engine 14 further includes a plurality of intake valves 26 configured to control the flow of inlet charge through the intake ports 24. Each intake valve 26 is at least partially disposed within a corresponding intake port 24. In particular, each intake valve 26 is configured to move along the corresponding intake port 24 between an open position and a closed position. In the open position, the intake valve 26 allows inlet charge to enter a corresponding combustion chamber 22A, 22B, 22C, or 22D via the corresponding intake port 24.

As discussed above, the internal combustion engine 14 can combust the air/fuel mixture once the air/fuel mixture enters the combustion chamber 22A, 22B, 22C, or 22D. This combustion generates exhaust gases. To expel these exhaust gases, the internal combustion engine 14 defines a plurality of exhaust ports 28. The exhaust ports 28 are in fluid communication with the combustion chambers 22A, 22B, 22C, or 22D. In the depicted embodiment, two exhaust ports 28 are in fluid communication with each combustion chamber 22A, 22B, 22C, or 22D. However, more or fewer exhaust ports 28 may be fluidly coupled to each combustion chamber 22A, 22B, 22C, or 22D.

The internal combustion engine 14 further includes a plurality of exhaust valves 30 in fluid communication with the combustion chambers 22A, 22B, 22C, or 22D. Each exhaust valve 30 is at least partially disposed within a corresponding exhaust port 28. In particular, each exhaust valve 30 is configured to move along the corresponding exhaust port 28 between an open position and a closed position. In the open position, the exhaust valve 30 allows the exhaust gases to escape the corresponding combustion chamber 22A, 22B, 22C, or 22D via the corresponding exhaust port 28.

The engine assembly 12 further includes a valve train system 32 configured to control the operation of the intake valves 26 and exhaust valves 30. Specifically, the valve train system 32 can move the intake valves 26 and exhaust valves 30 between the open and closed positions based at least in part on the operating conditions of the internal combustion engine 14 (e.g., engine speed). The valve train system 32 includes one or more camshaft assemblies 33 substantially parallel to the engine axis E. In the depicted embodiment, the valve train system 32 includes two camshaft assemblies 33. One camshaft assembly 33 is configured to control the operation of the intake valves 26, and the other camshaft assembly 33 can control the operation of the exhaust valves 30. It is contemplated, however, that the valve train system 32 may include more or fewer camshaft assemblies 33.

In addition to the camshaft assemblies 33, the valve train assembly 32 includes a plurality of actuators 34A, 34B, 34C, 34D, such as solenoids, in communication with the control module 16. The actuators 34A, 34B may be electronically connected to the control module 16 and may therefore be in electronic communication with the control module 16. The control module 16 may be part of the valve train system 32. In the depicted embodiment, the valve train system 32 includes first, second, third, and fourth actuators 34A, 34B, 34C, 34D. The first actuator 34A is operatively associated with the first and second cylinders 20A, 20B and can be actuated to control the operation of the intake valves 26 of the first and second cylinders 20A, 20B. The second actuator 34B is operatively associated with the third and fourth cylinders 20C and 20D and can be actuated to control the operation of the intake valves 26 of the third and fourth cylinders 20C and 20D. The third actuator 34C is operatively associated with the first and second cylinders 20A and 20B and can be actuated to control the operation of the exhaust valves 30 of the first and second cylinders 20A and 20B. The fourth actuator 34C is operatively associated with the third and fourth cylinders 20C and 20D and can be actuated to control the operation of the exhaust valves 30 of the third and fourth cylinders 20C and 20D. The actuators 34A, 34B, 34C, 34D and control module 16 may be deemed part of the camshaft assembly 33.

Figure 2:
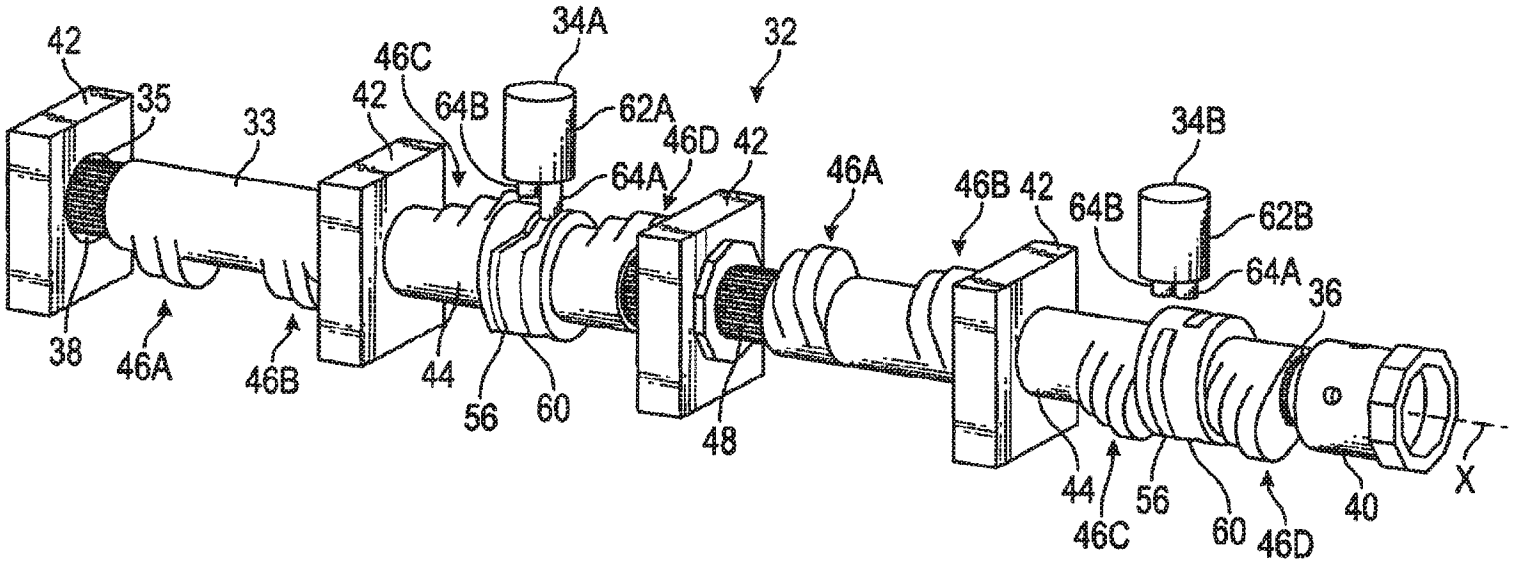
FIG. 2 is a schematic perspective view of a camshaft assembly of the engine assembly of FIG. 1 in accordance with an embodiment of the present disclosure.

With reference to FIG. 2, the valve train system 32 includes the camshaft assembly 33 and the actuators 34A, 34B as discussed above. The camshaft assembly 33 includes a base shaft 35 extending along a longitudinal axis X. The base shaft 35 includes a first shaft end portion 36 and a second shaft end portion 38 opposite the first shaft end portion 36.

Moreover, the camshaft assembly 33 includes a coupler 40 connected to the first shaft end portion 36 of the base shaft 35. The coupler 40 can be used to operatively couple the base shaft 35 to the crankshaft (not shown) of the engine 14. The crankshaft of the engine 14 can drive the base shaft 35. Accordingly, the base shaft 35 can rotate about the longitudinal axis X when driven by, for example, the crankshaft of the engine 14. The rotation of the base shaft 35 causes the entire camshaft assembly 33 to rotate about the longitudinal axis X. The base shaft 35 is therefore operatively coupled to the internal combustion engine 14.

The camshaft assembly 33 may additionally include one or more bearings 42, such as journal bearings, coupled to a fixed structure, such as the engine block 18. The camshaft assembly 33 further includes one or more axially lobe pack assemblies 44 mounted on the base shaft 35. The axially movable lobe pack assemblies 44 are configured to move axially relative to the base shaft 35 along the longitudinal axis X and are rotationally fixed to the base shaft 35. Consequently, the axially movable lobe pack assemblies 44 rotate synchronously with the base shaft 35. The base shaft 35 may include a spline feature 48 for maintaining angular alignment of the axially movable lobe pack assemblies 44 to the base shaft 35 and also for transmitting drive torque between the base shaft 35 and the axially movable lobe pack assemblies 44.

Figure 3:
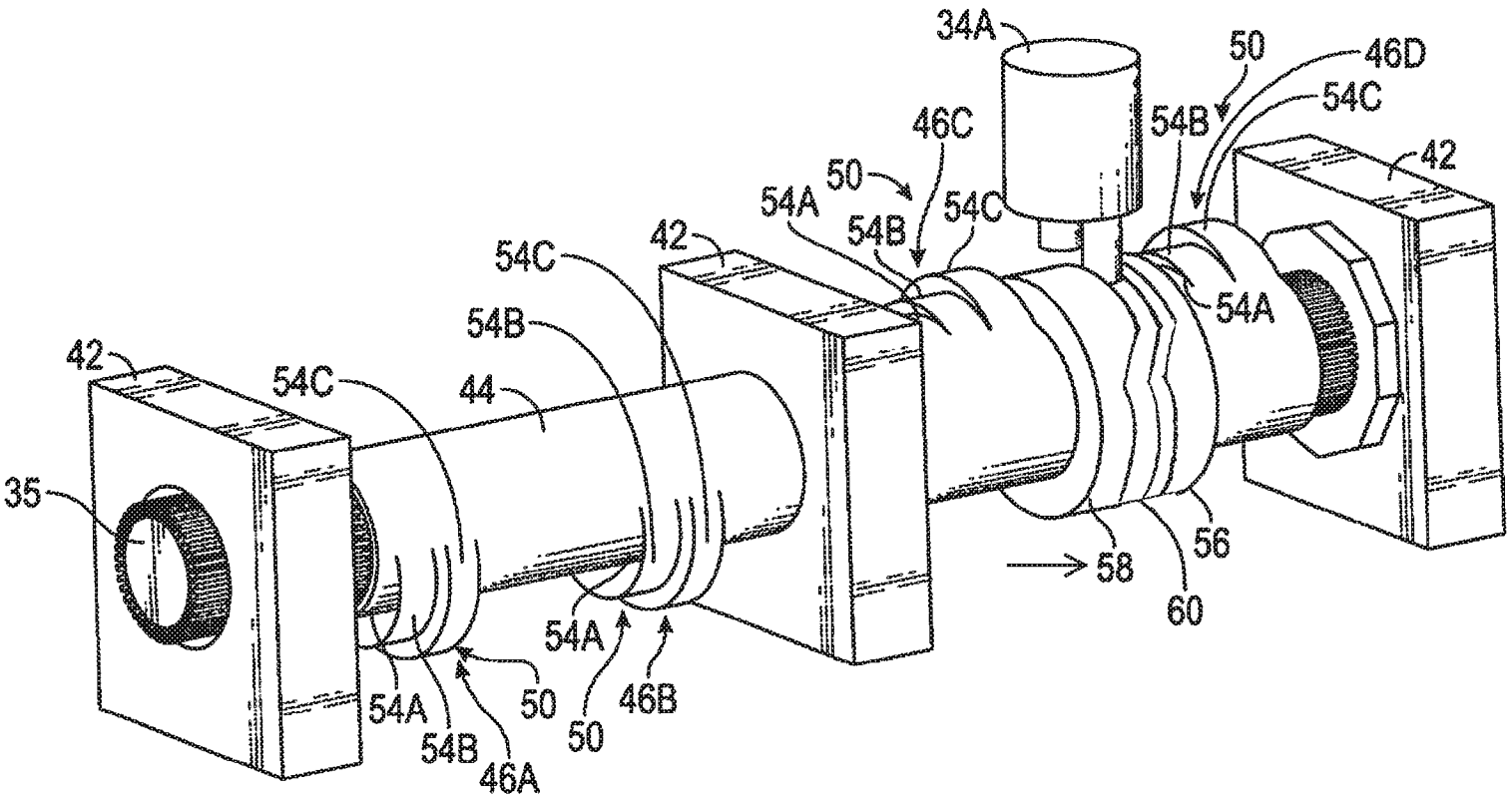
FIG. 3 is a schematic perspective view of a portion of the camshaft assembly of FIG. 2.

With specific reference to FIG. 3, each axially movable lobe pack assemblies 44 includes a first lobe pack 46A, a second lobe pack 46B, a third lobe pack 46C, and a fourth lobe pack 46D coupled to one another. The first, second, third, and fourth lobe packs 46A, 46B, 46C, 46D may also be referred to as cam packs. In addition, each axially movable lobe pack assemblies 44 only include a single barrel cam 56. Each barrel cam 56 defines a control groove 60. Each axially movable lobe pack assembly 44 may be a monolithic structure. Accordingly, the first, second, third, and fourth lobe packs 46A, 46B, 46C of the same axially movable lobe pack assemblies 44 can move simultaneously relative to the base shaft 35. The lobe packs 46A, 46B, 46C are nevertheless rotationally fixed to the base shaft 35. Consequently, the lobe packs 46A, 46B, 46C, 46D can rotate synchronously with the base shaft 35.

The first, second, third, and fourth lobe packs 46A, 46B, 46C, 46D each include only one group of cam lobes 50. The barrel cam 56 disposed between the third and fourth lobe packs 46C, 46D. Each axially movable member 44 includes only one barrel cam 56. The barrel cam 56 is axially disposed between the third and fourth lobe packs 46C, 46D. The two groups of lobes 50 of the third and fourth lobe pack 46C, 46D are axially spaced apart from each other.

Each group of cam lobes 50 includes a first cam lobe 54A, a second cam lobe 54B, and a third cam lobe 54C. It is envisioned that each group of cam lobes 50 may include more cam lobes. The cam lobes 54A, 54B, 54C have a typical cam lobe form with a profile that defines different valve lifts in three discrete steps. As a non-limiting example, one cam lobe profile may be circular (e.g., zero lift profile) in order to deactivate a valve (e.g., intake and exhaust valves 26, 30). The cam lobes 54A, 54B, 54C may have different lobe heights.

The barrel cam 56 includes a barrel cam body 58 and defines a control groove 60 extending into the barrel cam body 58. The control groove 60 is elongated along at least a portion of the circumference of the respective barrel cam body 58. Thus, the control groove 60 is circumferentially disposed along the respective barrel cam body 58. Further, the control groove 60 is configured, shaped, and sized to interact with one of the actuators 34A, 34B. As discussed in detail below, the interaction between the actuator 34A, 34B causes the axially movable structure 44 (and thus the lobe packs 46A, 46B, 46C, 46D) to move axially relative to the base shaft 35.

With reference to FIGS. 2 and 3, each actuator 34A, 34B includes an actuator body 62A, 62B, and first and second pins 64A, 64B movably coupled to the actuator body 62A, 62B. The first and second pins 64A, 64B of each actuator 34A, 34B are axially spaced apart from each other and can move independently from each other. Specifically, each of the first and second pins 64A, 64B can move relative to the corresponding actuator body 62A, 62B between a retracted position and an extended position in response to an input or command from the control module 16 (FIG. 1). In the retracted position, the first or second pin 64A or 64B is not disposed in the control groove 60. Conversely, in the extended position, the first or second pin 64A or 64B can be at least partially disposed in the control groove 60. Accordingly, the first and second pins 64A, 64B can move toward and away from the control groove 60 of the barrel cam 56 in response to an input or command from the control module 16 (FIG. 1). Hence, the first and second pins 64A, 64B of each actuator 34A, 34B can move relative to a corresponding barrel cam 56 in a direction substantially perpendicular to the longitudinal axis X.

Figure 4:
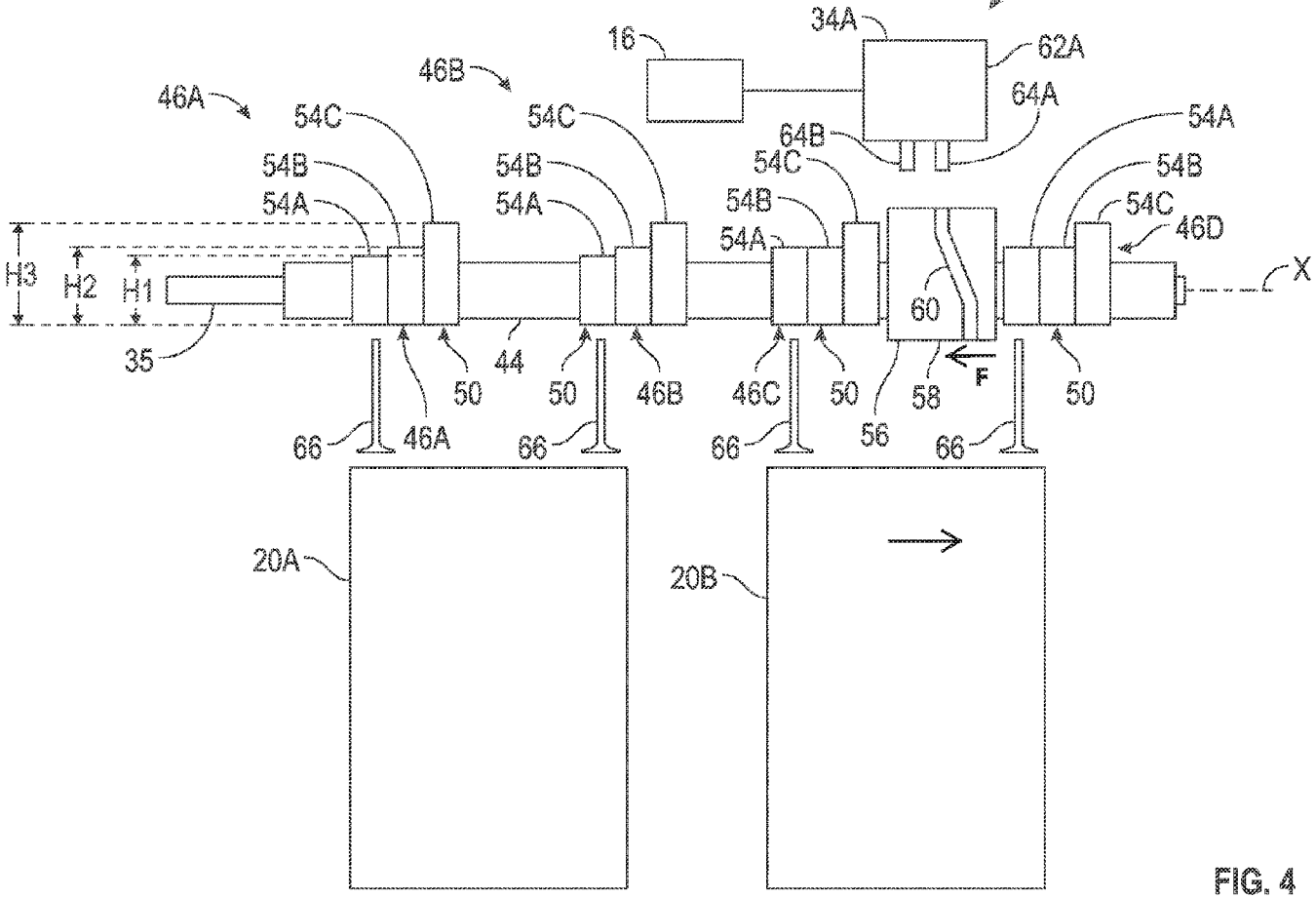
FIG. 4 is a schematic side view of a portion of the camshaft assembly and two engine cylinders, showing the lobe packs of the camshaft assembly in a first position.

With reference to FIG. 4, the camshaft assembly 33 includes at least one axially movable lobe pack assembly 44. Though FIG. 4 shows only one axially movable lobe pack assembly 44, it is contemplated that the camshaft assembly 33 may include more axially movable lobe pack assembly. The first and second lobe packs 46A, 46B are operatively associated with one cylinder 20A of the engine 14 (FIG. 1), while the third lobe pack 46C is operatively associated with another cylinder 20B of the engine 14. The axially movable structure 44 may also include more or fewer than four lobe packs 46A, 46B, 46C, 46D. Regardless of the number of lobe packs, each axially movable structure 44 may only include a single barrel cam 56. Accordingly, the camshaft assembly 33 may only include one barrel cam 56 for every two cylinders 20A, 20B. Because the barrel cam 56 interacts with one actuator 34A to move the axially movable structure 44 relative to the base shaft 35, the camshaft assembly 33 may only include a single actuator 34A (or 34B) for every two cylinders 20A, 20C. In other words, the camshaft assembly 33 may include a single actuator 34A for every two cylinders 20A, 20B. It is useful to have only one barrel cam 56 and only one actuator 34A for every two cylinders 20A, 20B in order to minimize manufacturing costs. It is also useful to have only one barrel cam 56 in each axially movable structure 44 in order to minimize manufacturing costs.

As discussed above, the first, second, third, and fourth lobe packs 46A, 46B, 46C, 46D each include one group of cam lobes 50. Each group of cam lobes 50, 52 includes a first cam lobe 54A, a second cam lobe 54B, and a third cam lobe 54C. The first cam lobe 54A may have a first maximum lobe height H1. The second cam lobe 54B has a second maximum lobe height H2. The third cam lobe 54C has a third maximum lobe height H3. The first, second, and third maximum lobe heights H1, H2, H3 may be different from one another. In the embodiment depicted in FIG. 4, the first, second, and third cam lobes 54A, 54B, 54C of the first and second lobe packs 46A, 46B have different maximum lobe heights, but the first and second cam lobes 54A, 54B of the third lobe pack 46C have the same maximum lobe heights. In other words, the first maximum lobe height H1 may be equal to the second maximum lobe height H2. Alternatively, the first maximum lobe height H1 may be different from the second maximum lobe height H2. The maximum lobe heights of the cam lobes 54A, 54B, 54C corresponds to the valve lift of the intake and exhaust valves 26, 30. The camshaft assembly 33 can adjust the valve lift of the intake and exhaust valves 26, 30 by adjusting the axial position of the cam lobes 54A, 54C, 54D relative to the base shaft 35. This can include a zero lift cam profile if desired. The cam lobes 54A, 54B, 54C of each group of cam lobes 50 are disposed in different axial positions along the longitudinal axis X.

Figure 5:
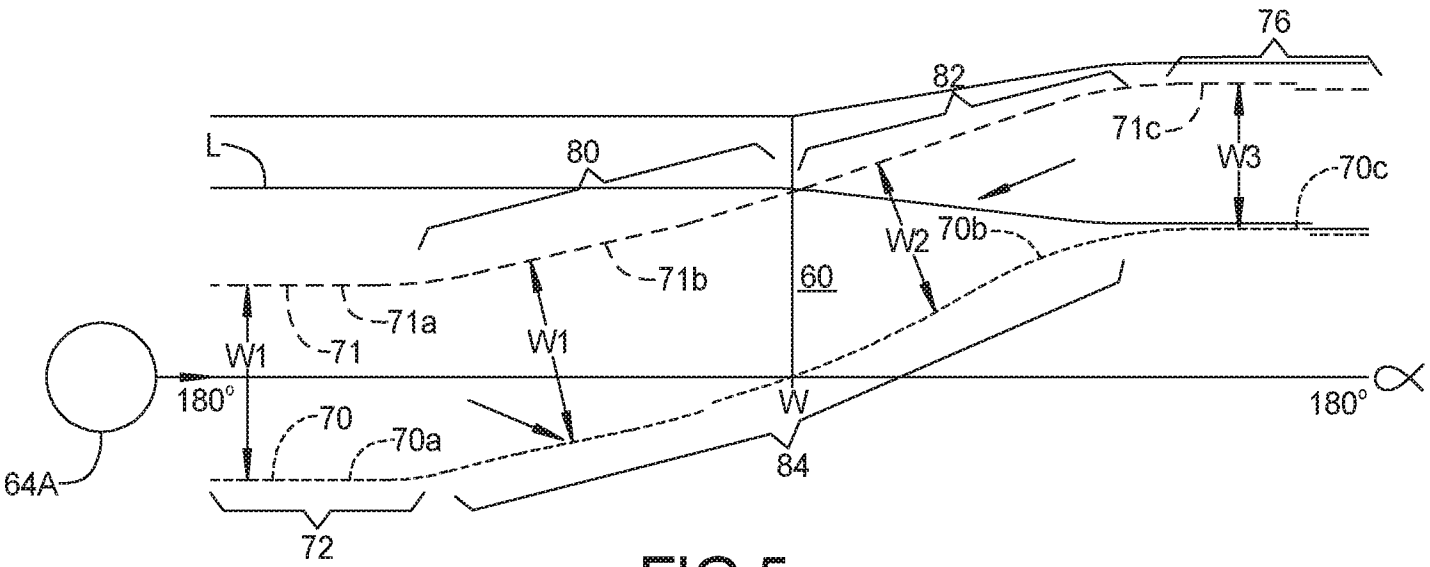
FIG. 5 is a schematic side view a of a barrel cam of the camshaft assembly shown in FIG. 4, depicting the arc length of a control groove of the barrel cam.

With reference to FIGS. 4-5, the lobe pack 46A, 46B, 46C, 46D can move relative to the base shaft 35 between a first position (FIG. 4), a second position, and a third position. To do so, the barrel cam 56 can physically interact with the actuator 34A. As discussed above, the barrel cam 56 includes a barrel cam body 58 and defines a control groove 60 extending into the barrel cam body 58. The control groove 60 is elongated along at least a portion of the circumference of the respective barrel cam body 58.

FIG. 5 schematically illustrates a portion of the control groove 60 of the barrel cam 56. The control groove 60 includes a pair of sidewalls 70, 71 that define a pin engagement region 72, a shifting region 74 and an ejection region 76. Wall 70 is a push wall and wall 71 is a catch wall. The pin engagement region 72 of the control groove 60 has a first groove width W1 that can be constant or that can vary between width W1 and W1' between first portion 70*a*, 71*a* of the pair of the sidewalls 70, 71, the first groove width being disposed along a first plane orthogonal to a rotational axis of the base shaft 35.

The shifting region 74 extends from the pin engagement region 72 and has a second portion 70*b*, 71*b* of the sidewalls 70, 71 that are angled relative to the first parallel portion 70*a*, 71*a* of the sidewalls 70, 71. The shifting region 74 may also include a first portion 80 extending from the pin engagement region 72 that may have a same width as the first groove width W1 or that may vary in width. The shifting region 74 has a second portion 82 with a varying groove width W2 that continuously varies relative to the first groove width W1. The varying groove width portion W2 can extend along approximately the last half of the shifting region 74. The ejection region 76 extends from the shifting region 74 and has a parallel third portion 70*c*, 71*c* of the pair of sidewalls 70, 71 and having a third groove width W3 narrower than the first groove width W1. The sidewalls within the parallel first portion 70*a* and the parallel third portion 70*c* of the pair of sidewalls 70 are perpendicular to the rotational axis X of the base shaft 35. The graph line L in FIG. 5 graphically illustrates the width of the groove 60 along the length of the groove 60 relative to the superimposed rotational axis a and the width axis W. The width of the grooves can be varied through each section of the engagement, shifting and ejection groove based on durability of the components.

In FIG. 4, the axially movable structure 44 is in a first position relative to the base shaft 35. When the axially movable structure 44 in the first position relative to the base shaft 35, the lobe packs 46A, 46B, 46C, 46D are in the first position and, the first cam lobe 54A of each lobe pack 46A, 46B, 46C, 46D is substantially aligned with the engine valves 66. The engine valves 66 represent intake or exhaust valves 26, 30 as described above. In the first position, the first cam lobes 54A are operatively coupled to the engine valves 66. As such, the engine valves 66 have a valve lift that corresponds to the first maximum lobe height H1, which is herein referred to as a first valve lift. In other words, when the lobe packs 46A, 46B, 46C, 46D are in the first position, the engine valves 66 have a first valve lift, which corresponds to the first maximum lobe height H1.

During operation, the axially movable structure 44 and the lobe packs 46A, 46B, 46C, 46D can move between a first position (FIG. 4), a second position and a third position to adjust the valve lift of the engine valves 66. As discussed above, in the first position (FIG. 4), the first cam lobes 54A are substantially aligned with the engine valves 66. The rotation of the lobe pack 46A, 46B, 46C, 46D causes the engine valves 66 to move between the open and closed positions. When the lobe packs 46A, 46B, 46C, 46D are in the first position (FIG. 4), the valve lift of the engine valves 66 may be proportional to the first maximum lobe height H1.

To move the axially movable structure 44 from the first position (FIG. 4) to the second position, the control module 16 can command the actuator 34A to move its first pin 64A from the retracted position to the extended position while the base shaft 35 rotates about the longitudinal axis X. In the extended position, the first pin 64A is at least partially disposed in the control groove 60. The pin engagement region 72 of the control groove 60 is therefore configured, shaped, and sized to receive the first pin 64A when the first pin 64A is in the extended position. At this point, the first pin 64A of the actuator 34A rides along the shifting region 74 (FIG. 5) of the control groove 60 as the lobe packs 46A, 46B, 46C rotate about the longitudinal axis X. As the first pin 64A rides along the shifting region 74 (FIG. 5) of the control groove 60, the axially movable structure 44 and the lobe packs 46A, 46B move axially relative to the base shaft 35 from the first position (FIG. 4) to a second position in a first direction F. Because the control groove 60 has a varying depth, the first pin 64A of the actuator 34A can be moved mechanically to its retracted position as the first pin 64A rides along the ejection region 76 of the control groove 60. Alternatively, the control module 16 can command the first actuator 34A to move the first pin 64A to the retracted position.

The detailed description and the drawings or figures are supportive and descriptive of the invention, but the scope of the invention is defined solely by the claims. While some of the best modes and other embodiments for carrying out the claimed invention have been described in detail, various alternative designs and embodiments exist for practicing the invention defined in the appended claims. The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A camshaft assembly, comprising:

a base shaft including at least one lobe pack axially movably mounted on the base shaft, the lobe pack including a control groove therein;

an actuator device including an actuator body and a pin movably mounted to the actuator between a retracted position and an extended position for engaging with the control groove to cause axial movement of the lobe pack;

wherein the control groove includes a pin engagement region, a shifting region and an ejection region, the pin engagement region of the control groove having a first pair of parallel sidewalls with a first groove width therebetween and being disposed along a first plane orthogonal to a rotational axis of the base shaft, the shifting region extending from the pin engagement region and having a second pair of sidewalls angled relative to the first pair of parallel sidewalls and having a first portion with a varying groove width that varies relative to the first groove width, and the ejection region extending from the shifting region and having a third pair of parallel sidewalls extending along a second plane orthogonal to the rotational axis of the base shaft and axially spaced from the first plane and having a second groove width narrower than the first groove width.

2. The camshaft assembly according to claim 1, wherein the shifting region includes a second portion having a third groove width equal to the first groove width.

3. An engine assembly, comprising:

an engine structure including a block and a cylinder head that define a plurality of cylinders;

a plurality of pistons disposed in the plurality of cylinders;

a crankshaft drivingly connected to the plurality of pistons;

a camshaft assembly drivingly connected to the crankshaft and including;

a base shaft including at least one lobe pack axially movably mounted on the base shaft, the lobe pack including a control groove therein;

an actuator device including an actuator body and a pin movably mounted to the actuator between a retracted position and an extended position for engaging with the control groove to cause axial movement of the lobe pack;

wherein the control groove includes a pin engagement region, a shifting region and an ejection region, the pin engagement region of the control groove having a first pair of parallel sidewalls with a first groove width therebetween and being disposed along a first plane orthogonal to a rotational axis of the base shaft, the shifting region extending from the pin engagement region and having a second pair of sidewalls angled relative to the first pair of parallel sidewalls and having a first portion with a varying groove width that narrows relative to the first groove width, and the ejection region extending from the shifting region and having a third pair of parallel sidewalls extending along a second plane orthogonal to the rotational axis of the base shaft and axially spaced from the first plane and having a second groove width narrower than the first groove width.

4. The engine assembly according to claim 3, wherein the shifting region includes a second portion having a third groove width equal to the first groove width.

* * * * *